US005406726A

United States Patent [19]

Fan

[11] Patent Number: 5,406,726

[45] Date of Patent: Apr. 18, 1995

[54] CLAMPING BOARD FOR NAME CARD

[76] Inventor: Eagle Fan, No. 30 Lu-Chang, Chu Pei City, Hsinchu Hsien, Taiwan, Prov. of China

[21] Appl. No.: 265,454

[22] Filed: Jun. 24, 1994

[51] Int. Cl.[6] ..... A44C 3/00

[52] U.S. Cl. ..... 40/1.6; 40/1.5; 40/666

[58] Field of Search ..... 273/148 R, 148 A; 40/1.5, 1.6, 666; D20/22, 25, 27, 28

[56] References Cited

U.S. PATENT DOCUMENTS

| | | | |
|---|---|---|---|
| 585,109 | 6/1897 | Lawrence et al. | 40/1.5 |
| 1,193,265 | 8/1916 | Honecker | 40/666 |
| 1,236,654 | 8/1917 | Baltzley | 40/666 X |
| 1,622,682 | 3/1927 | Sponsel | 40/666 X |
| 1,700,977 | 2/1929 | Butler | 40/666 |
| 2,112,048 | 3/1938 | Robinson | 40/666 |
| 3,931,688 | 1/1976 | Owens | 40/1.5 |
| 4,937,963 | 7/1990 | Barnes | 40/1.6 |

FOREIGN PATENT DOCUMENTS

| | | | |
|---|---|---|---|
| 2068888 | 8/1981 | United Kingdom | 40/1.6 |
| 2242669 | 10/1991 | United Kingdom | 40/1.5 |

*Primary Examiner*—William E. Stoll
*Attorney, Agent, or Firm*—Notaro & Michalos

[57] ABSTRACT

A clamping card board, which is integrally made of an elastic material such as rubber by pressing so as to reduce cost and manufacturing time, is disclosed. The clamping card board includes a plurality of separable clamping boards, on each of which a clamping portion is mounted, so as to tightly clamp articles as a result of the elasticity thereof.

7 Claims, 5 Drawing Sheets

CLAMPING BOARD FOR NAME CARD

FIELD OF THE INVENTION

The present invention relates generally to a board for mounting a name card or the like thereon and more particularly to a clamping board, which is integrally made of an elastic material such as rubber by pressing, so that the clamping board can be bent to tightly clamp articles such as shirt pockets or pieces of paper without using pins.

BACKGROUND OF THE INVENTION

Usually, in a business meeting or in an international conference, to proceed programs efficiently, every attendant is required to pin a board, on which a name card is mounted, to a shirt pocket for identification. The conventional board is provided with a transparent shell for receiving the name card therethrough and a pin for fixing the shell to the shirt pocket. But, the function of the conventional board is limited, while the structure is not simple enough.

SUMMARY OF THE INVENTION

Accordingly, it is a primary object of the present invention to provide a clamping board or clamping card board which is integrally made of an elastic material such as rubber so as to be bent to tightly clamp articles without using pins and the structure of the clamping board is simple.

According to the above-mentioned object, the present invention provides a clamping board comprising a plurality of separable clamping boards, on each of which a clamping portion is mounted, so as to tightly clamp articles as a result of elasticity thereof. Some characteristics of the present invention are as follows:

(1) The clamping board comprises a board, on which a name card is mounted, having a pair of elongated slots formed on two respective sides thereof to engagedly receive therein two respective ends of the name card, a clamping portion, which is easily forced to move apart slightly therefrom so that the clamping board can tightly clamp a shirt pocket by the elasticity thereof, and a hanging hole;

(2) The clamping board is integrally made of an elastic material such as rubber by pressing in order to reduce cost and manufacturing time;

(3) The clamping board comprises a plurality of separable clamping boards, on each of which a clamping portion is mounted and able to tightly clamp a plurality of articles respectively as a result of elasticity thereof; and (4) The clamping portion can be forced to move apart from the board to go beyond the elastic limit so as to serve together with the board to make the clamping board firmly stand on a table.

The above object, features and advantages of the invention will become readily apparent from the following detailed description thereof which is to be read in connection with the accompanying drawings.

DETAILED DESCRIPTION OF THE PREFERRED EMBODIMENT

Figure 1:
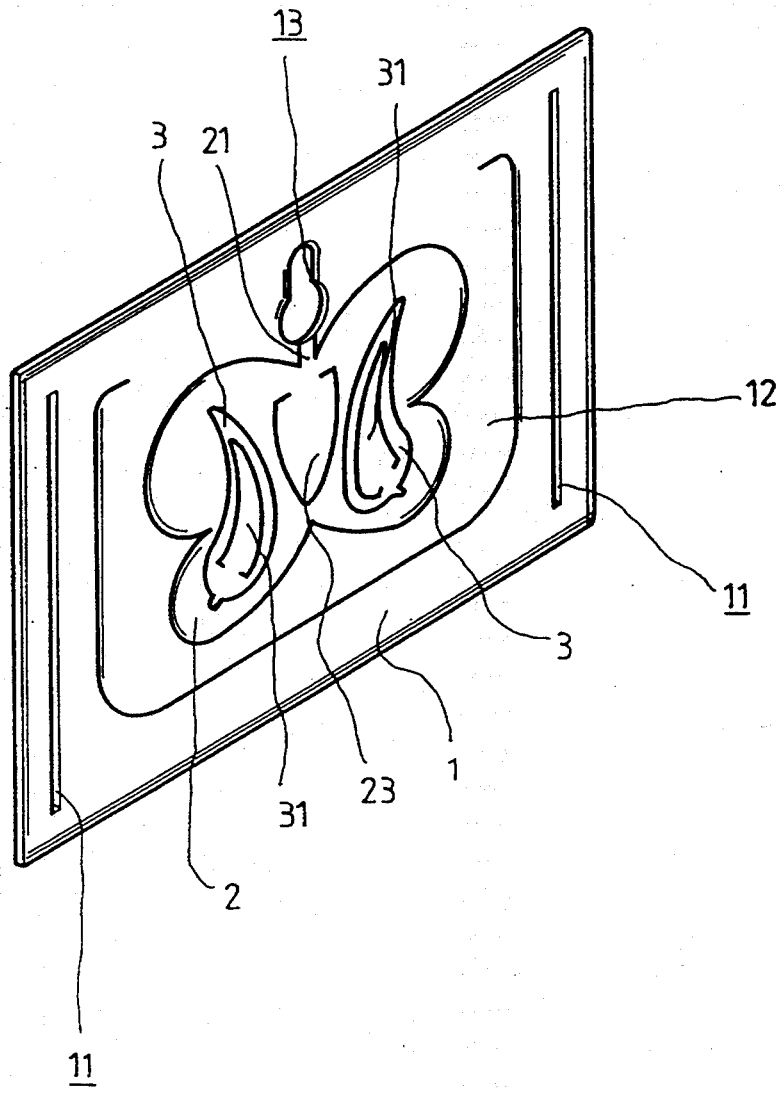
FIG. 1 is a perspective view of a clamping board in accordance with the present invention.
Figure 2:
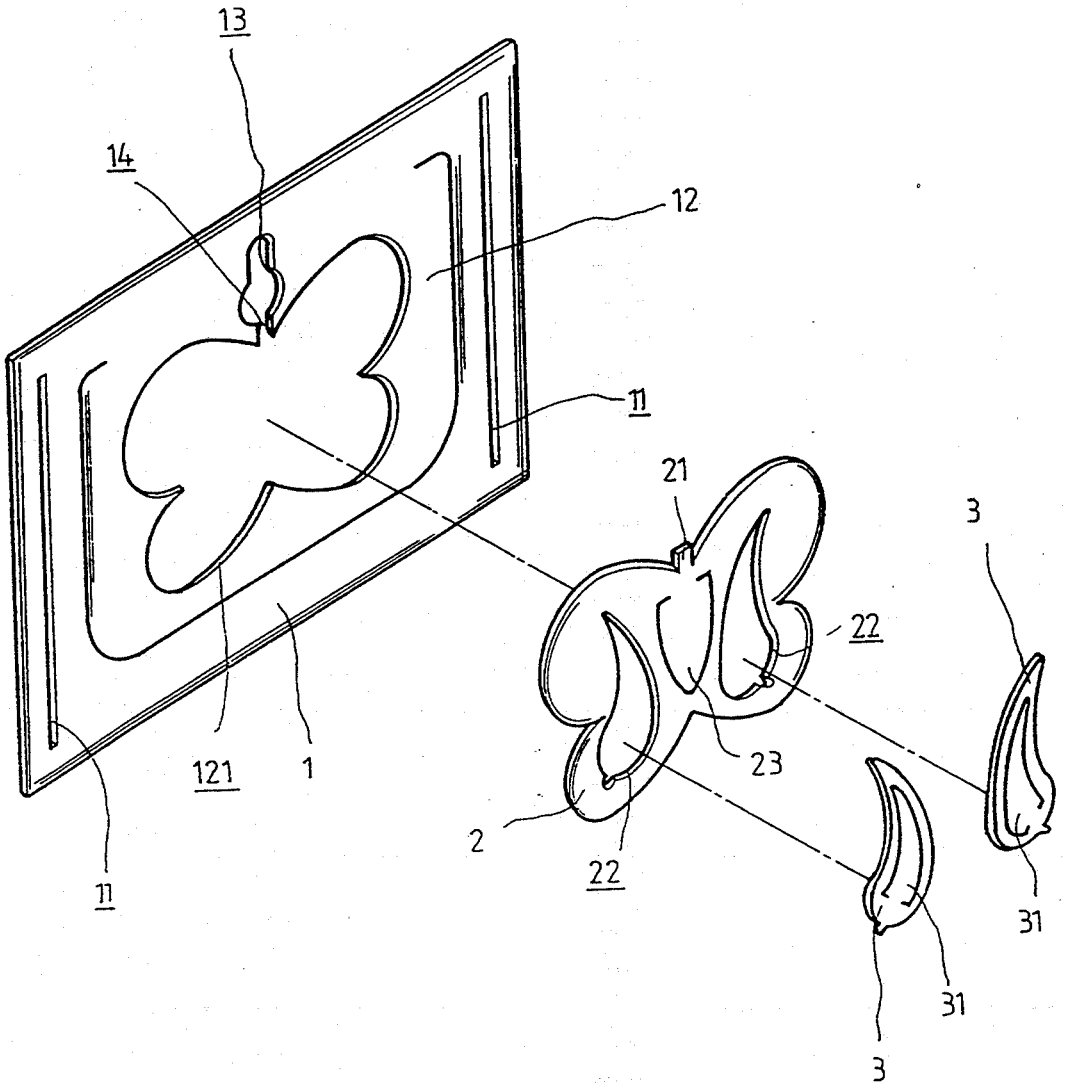
FIG. 2 is an exploded perspective view thereof.

Referring to FIGS. 1 and 2, a clamping board or clamping card board, which is integrally made of an elastic material such as rubber by pressing, comprises a board 1, on which a card such as name card 20 (see FIG. 3) is mounted, having a pair of elongated slots 11 formed on two respective sides thereof to engagedly receive therein two respective ends of the name card 20. The board 1 comprises a clamping portion 12, a top region of a circumference of which extending from an upper portion thereof and a remain U-shaped circumference of which separated therefrom by a gap, so that the clamping portion 12 can be easily forced to move apart slightly therefrom as shown in FIG. 4 and then the clamping board can tightly clamp an article such as shirt pocket 30 as a result of elasticity thereof. The board 1 further has an inverse key-shaped hanging hole 13 formed on the upper central region thereof and the clamping portion 12 has a butterfly-shaped slot 121 formed thereon. Also, a passage 14 is formed between the hanging hole 13 and the butterfly-shaped slot 121.

The clamping board further comprises a first clamping board 2 for holding articles such as pieces of paper, having a butterfly shape to be engagedly received within the butterfly-shaped slot 121 and comprising a top projection 21 to be engagedly received within the passage 14 so that the first clamping board 2 can be stored therein. The first clamping board 2 has a pair of inverse V-shaped slots 22 formed on two respective sides thereof and a first inner clamping portion 23, a top region of a circumference of which extending from an upper portion thereof and a remain V-shaped circumference of which separated therefrom by a gap, so that the first inner clamping portion 23 can be easily forced to move apart slightly therefrom and then the first clamping board 2 can tightly clamp pieces of paper as a result of elasticity thereof.

The clamping board also comprises a pair of second clamping boards 3, each of which having an inverse V shape to be engagedly received within the inverse V-shaped slots 22 of the first clamping board 2 respectively, so that the second clamping boards 3 can be stored therein. Each of the second clamping boards 3 comprises a second inner clamping portion 31, a bottom region of a circumference of which extending from a lower portion thereof and a remain inverse V-shaped circumference of which separated therefrom by a gap, so that each second inner clamping portion 31 can be easily forced to move apart slightly therefrom and then the second clamping boards 3 can tightly clamp articles such as pieces of paper as a result of elasticity thereof.

Figure 3:
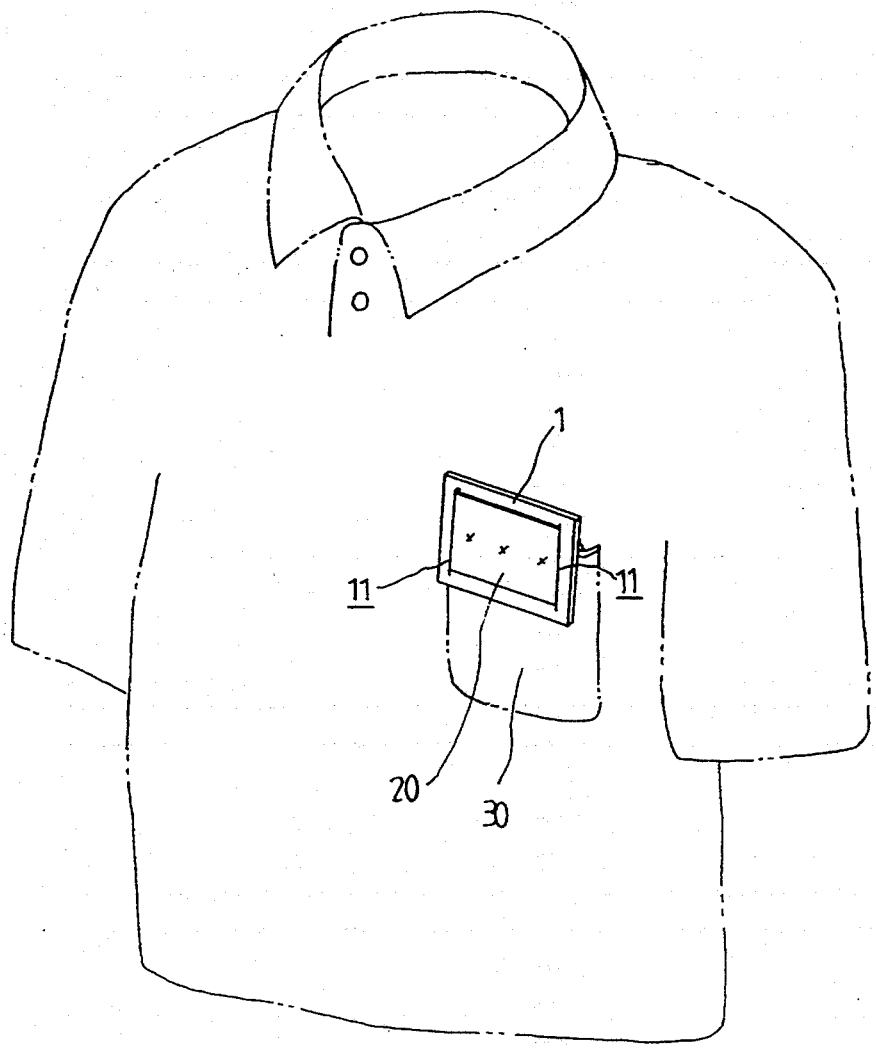
FIG. 3 is a perspective view thereof and a name card mounted thereon showing a first application thereof to hold a shirt pocket.
Figure 4:
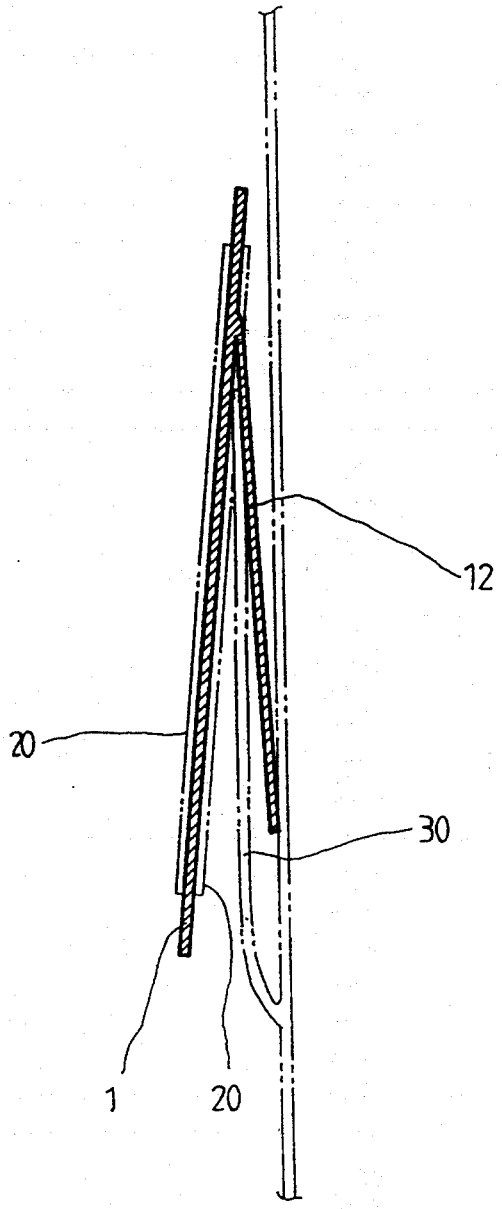
FIG. 4 is a cross-sectional view of the application thereof to hold the shirt pocket in FIG. 3.

FIG. 3 shows a first application of the clamping board to clamp the shirt pocket 30 and FIG. 4 is a cross-sectional view of the application in which the two ends of the name card 20 are engagedly received within the elongated slots 11 of the board 1 to secure the name card 20. And, the clamping portion 12 is forced to move apart from the board 1 and then the clamping board can tightly clamp the shirt pocket 30 as a result of elasticity thereof.

Figure 5:
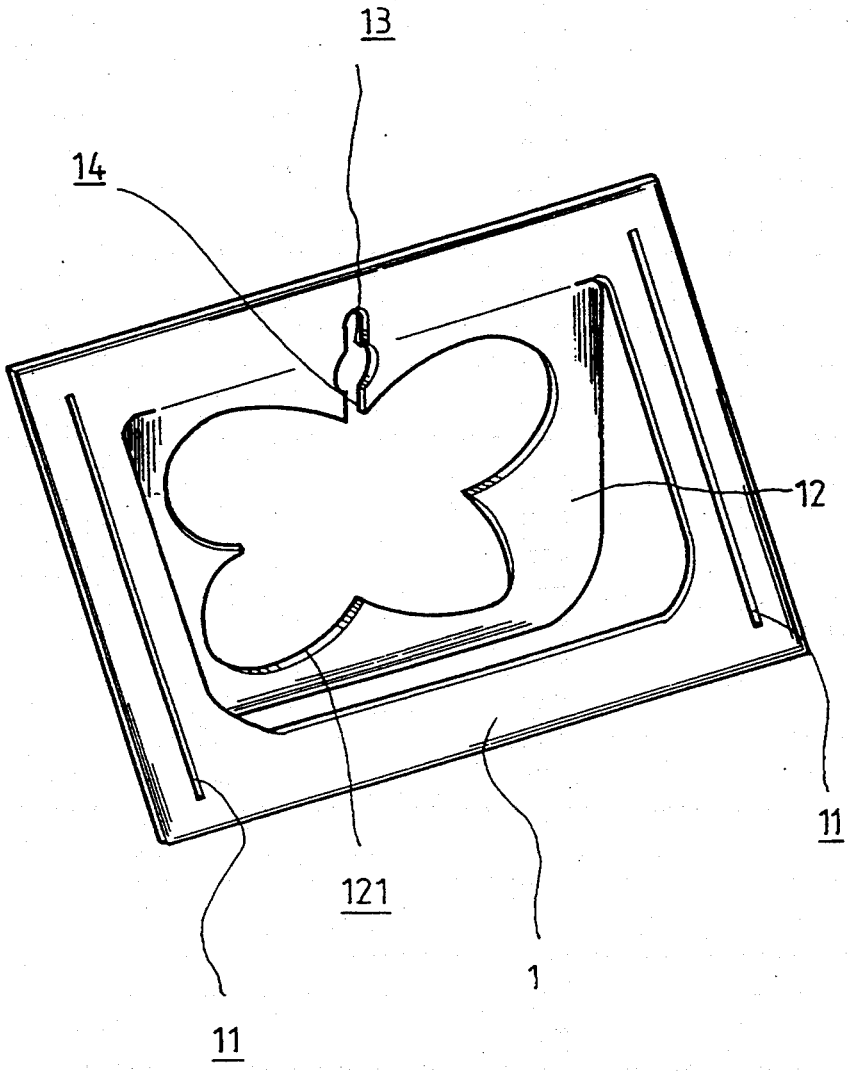
FIG. 5 is a perspective view thereof showing another application thereof.

FIG. 5 shows another application of the clamping board, especially in a business meeting or an international conference. When forced to move apart from the board 1 beyond the elastic limit, the clamping portion 12 is unable to restore to normal so that the clamping card board can firmly stand on a table where a bottom of the board 1 serves as front support and a bottom of the clamping portion 12 serves as rear support. Thus, with the name card 20 mounted on the clamping card board of the present invention, every attendant can be recognized immediately.

Having described the specific preferred embodiment of the present invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A clamping card board, which is integrally made of an elastic material, comprising a board, on which a card is mounted, having a pair of elongated slots formed on two respective sides thereof to engagedly receive therein two respective ends of the card; a clamping portion, a top region of a circumference of which extends from an upper portion of the card board and a remaining circumference of which is separated from the board, having a first slot formed thereon; a first clamping board, which is engagedly receivable within the first slot of the clamping portion to be stored therein; and a first inner clamping portion, a top region of a circumference of which is extending from an upper portion of the first clamping board and a remaining circumference of which is separated from the first clamping board so that when the clamping portion is forced to move apart from the board, the clamping card board tightly clamps articles as a result of the elasticity thereof or when the clamping portion is forced to move apart from the board beyond the elastic limit, the clamping card board firmly stands on a table where a bottom of the board serves as a front support and a bottom of the clamping portion serves as a rear support and also when the first inner clamping portion is forced to move apart from the first clamping board, the first clamping board tightly clamps articles as a result of the elasticity thereof.

2. A clamping card board as claimed in claim 1, wherein the clamping card board further has a hanging hole formed on an upper central region thereof.

3. A clamping card board as claimed in claim 1, wherein the first slot of the clamping portion has a butterfly shape and the first clamping board has a corresponding butterfly shape.

4. A clamping card board as claimed in claim 1, wherein the clamping portion has a U shape.

5. A clamping card board as claimed in claim 1, wherein the first inner clamping portion has a V shape.

6. A clamping card board as claimed in claim 1, wherein the clamping card board further comprises at least one second clamping board and a second inner clamping portion, a bottom region of a circumference of which is extending from a lower portion of the second clamping board and a remaining circumference of which is separated from the second clamping board, so that when the second inner clamping portion is forced to move apart from the second clamping board, the second clamping board tightly clamps articles as a result of the elasticity thereof and also the first clamping board has at least one second slot formed thereon to engagedly receive therein the second clamping board.

7. A clamping card board as claimed in claim 6, wherein the second slot of the first clamping board has an inverse V shape, the second clamping board has a corresponding inverse V shape, and the second inner clamping portion has an inverse V shape.

* * * * *